US007692111B1

(12) United States Patent
Rosing et al.

(10) Patent No.: US 7,692,111 B1
(45) Date of Patent: Apr. 6, 2010

(54) ILLUMINATING STRUCTURE

(75) Inventors: Dustin Rosing, San Diego, CA (US); Larry Trigg, Santa Clara, CA (US); Tom Neal, Cupertino, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1058 days.

(21) Appl. No.: 11/192,959

(22) Filed: Jul. 29, 2005

(51) Int. Cl.
*H01H 9/16* (2006.01)
*H01H 9/18* (2006.01)

(52) U.S. Cl. ..... 200/310; 200/314; 200/317

(58) Field of Classification Search ..... 200/310–317; 341/22, 23, 28; 345/156, 168–170, 172; 362/23, 26, 29, 30, 394, 602, 619
See application file for complete search history.

(56) References Cited

U.S. PATENT DOCUMENTS 3,626,171 A * 12/1971 Abramowitz et al. ..... 200/314
4,419,555 A * 12/1983 Kim ..... 200/314
4,507,528 A * 3/1985 Vogel et al. ..... 200/302.2
6,743,993 B1 * 6/2004 Clark et al. ..... 200/314
6,984,797 B2 * 1/2006 Morita et al. ..... 200/314
7,193,170 B2 * 3/2007 Katayama et al. ..... 200/314
7,229,196 B2 * 6/2007 Hulse ..... 362/341
7,244,898 B2 * 7/2007 Kim ..... 200/314
7,253,369 B2 * 8/2007 Fu et al. ..... 200/310

* cited by examiner

*Primary Examiner*—Michael A Friedhofer

(57) ABSTRACT

A distinctive structure, such as an illuminating structure is provided. The illuminating structure includes an illuminating element that is placed in an opening of a surrounding area. The opening includes a curved side wall of a particular radius to reflect any light that emanates from the illuminating element so that the reflected light is viewable from the illuminating structure.

17 Claims, 6 Drawing Sheets

ILLUMINATING STRUCTURE

BACKGROUND

Companies are constantly working to distinguish themselves through the quality of their offerings. However, quality alone is often time not enough to differentiate a company from its competitors. Thus, companies often employ product design to further expound the quality of their products and communicate their distinctiveness to the marketplace. Accordingly, product design is a key ingredient to the creation, development, and delivery of a competitive product to the marketplace. A cohesively-designed product pallet with recognizable, superior, and distinctive elements or components across the product pallet also serve to strengthen a name brand and further boost the sales power of branded products.

The power indicator or power button on an electrically-powered device or product is one such recognizable element. It is functionally separate from other interaction points on the product. It is also ubiquitous across multiple products or product types, providing an opportunity for a high signature impact across the product pallet of a company or name brand. With common consistency, quality, and appearance in the design of the power button across multiple products in a product pallet, the perception of product quality can be transferred and reinforced across the multiple products. As a result, a company can become positively distinctive through not just one of its products but a whole line or lines of its products, which can further enhance the value and quality perception of such products.

BRIEF DESCRIPTION OF THE DRAWINGS

Embodiments are illustrated by way of example and not limited in the following figure(s), in which like numerals indicate like elements, in which.

DETAILED DESCRIPTION

For simplicity and illustrative purposes, the principles of the embodiments are described by referring mainly to examples thereof. In the following description, numerous specific details are set forth in order to provide a thorough understanding of the embodiments. It will be apparent however, to one of ordinary skill in the art, that the embodiments may be practiced without limitation to these specific details. In other instances, well known methods and structures have not been described in detail so as not to unnecessarily obscure the embodiments.

A method and apparatus for a distinctive structure are described herein. The distinctive structure is operable and scaleable for implementation of elements or components across multiple devices with common consistency and quality and a common appearance across the multiple devices. One example of a distinctive structure is a power indicator structure or a power button structure. As referred herein, a power indicator is an element that provides an indication of a power on/off of a part or device. Whereas, a power button is an element, such as a mechanically-actuated button, that is operable to effect the power on or off of a part or device. As referred herein, a mechanically-actuated button is any button or switch that performs a mechanical, electrical, or electronic function or action in response to a tactile input or mechanical actuation thereon. It is possible to have a power button that also operates as a power indicator to provide power on/off indication. Likewise, it is possible to have a power indicator that also operates as a power button to effect the power on/off of a part or device. Although embodiments for a power button structure are described herein, it should be understood that such embodiments are applicable for any structures, including but not limited to power indicator structures, slider switch structures, keyboard key structures, display screen perimeter structures, DVD drive structures, and other mechanically-actuated button structures.

Figure 1A:
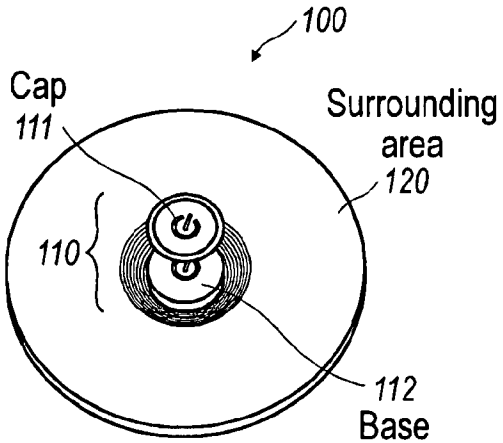
FIGS. 1A-F illustrate various views of a distinctive structure such as a power button structure in accordance with one embodiment.
Figure 1B:
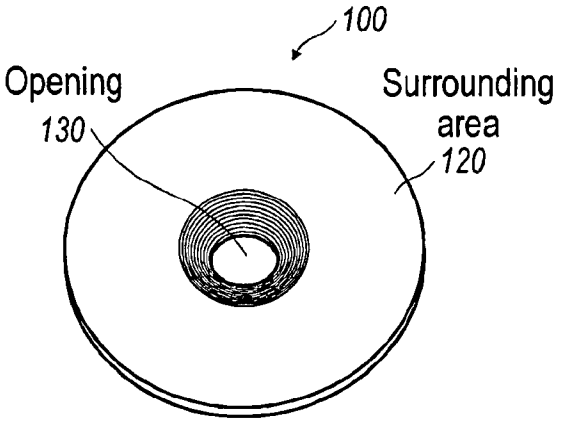
Figure 1C:
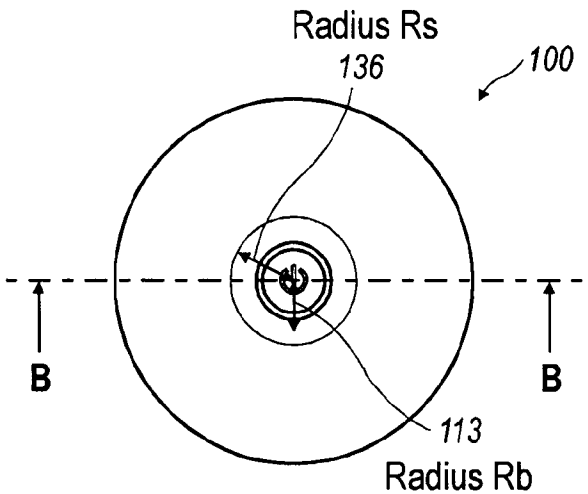
Figure 1D:
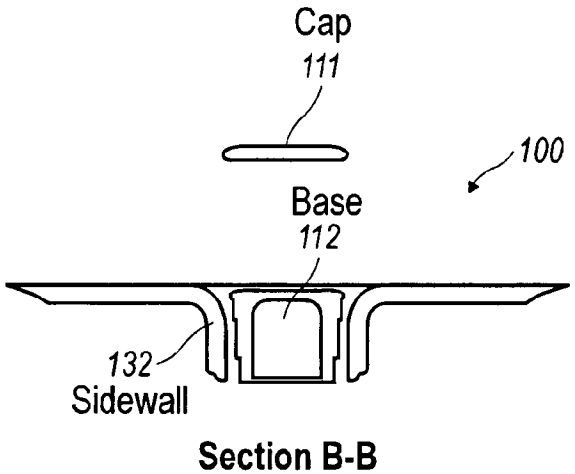
Figure 1F:
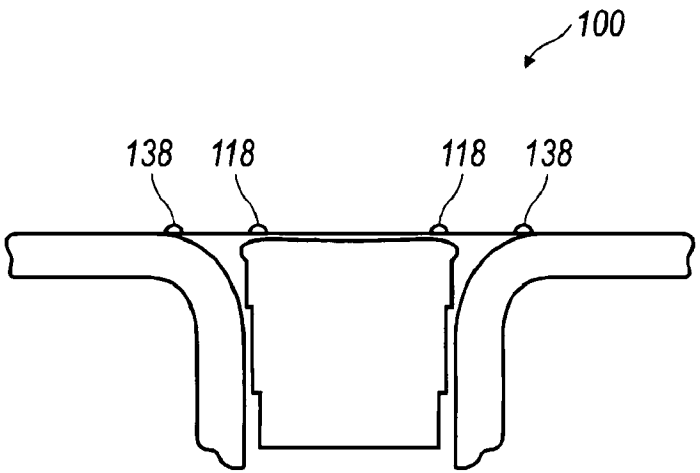
Figure 1E:
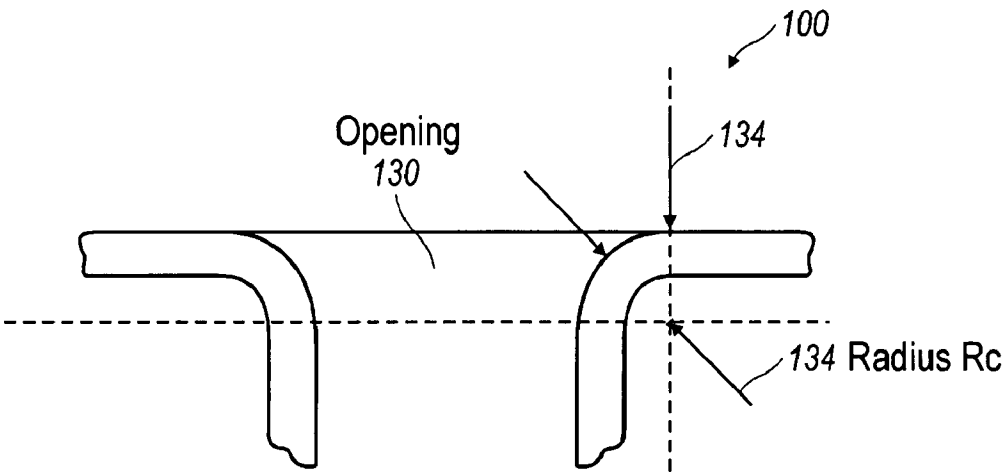

FIGS. 1A-E illustrate a power button structure 100 in accordance with one embodiment. Specifically, FIG. 1A illustrates a perspective top view of the power button structure 100. FIG. 1B illustrates a perspective top view of the power button structure 100 without the power button 110 to exemplify the surrounding area 120 of the power button structure 100. FIG. 1C illustrates a top view of the power button structure 100. FIG. 1D illustrates a cross section of the power button structure 100 taken along the line B-B indicated in FIG. 1C. FIG. 1E illustrates a cross section of the power button structure 100 as illustrated in FIG. 1C but with the power button removed.

As illustrated in FIG. 1A, the power button structure 100 includes a power button 110 and a surrounding area 120. The view shown in FIG. 1A is partially exploded to show a button cap 111. The power button 110 includes at least two components, such as the button cap 111 and a base 112, which assists in the mechanical actuation of the power button 110 in a manner known in the art. To that extent, the base 112 is fabricated from any material suitable for the purpose of mechanical actuation. The button cap 111 is arranged on top of and interfaces with the base 112. Examples of a material for the button cap 111 include but are not limited to: rigid-molded opaque plastic and stamped metal. In one embodiment, the button cap 111 includes on its surface a bevel portion 117 and a concave portion 119.

Figure 2B:
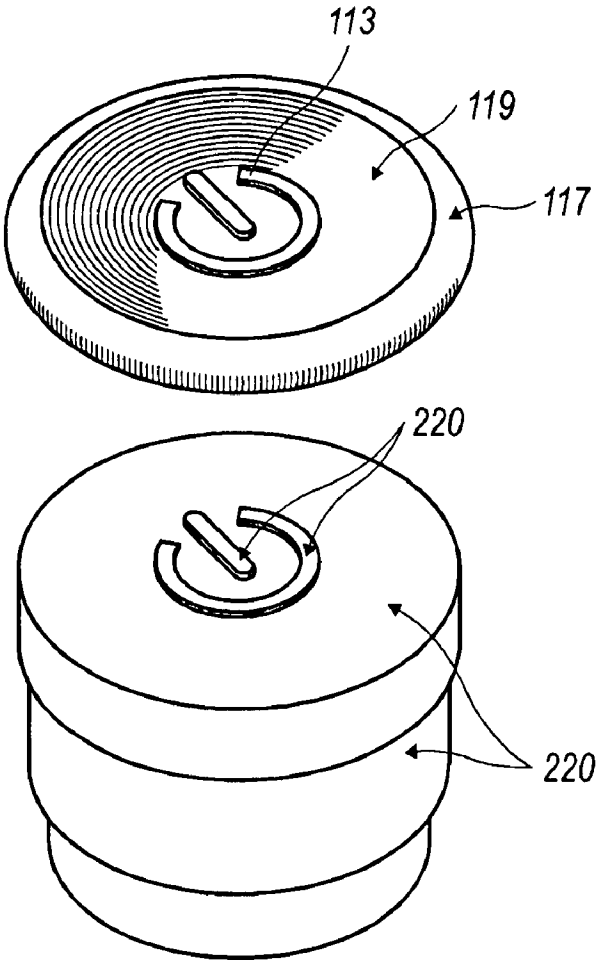
FIGS. 2A-B illustrate various views of a power button in the power button structure illustrated in FIGS. 1A-D in accordance with one embodiment.
Figure 2A:
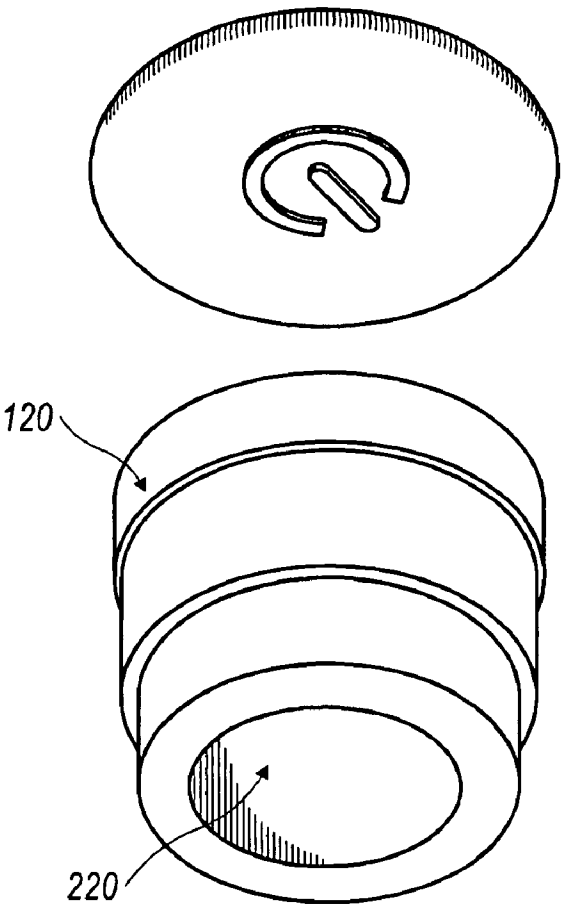

FIGS. 2A-B further illustrate a perspective bottom view and perspective top view of the power button 110, respectively. The button cap 111 optionally includes an icon 113 shown in FIG. 2B. As referred herein, an icon is any pictorial representation, such as letters or symbols on keys of a keyboard, that may or may not suggest the purpose of an available function. In one embodiment the icon 113 is colored or made out of a material such that it is visually or tactilely identifiable and distinguishable from other areas of the button cap 111 in order to illustrate the design or outline of the icon 113. For example, the icon 113 is painted or made out of a material such that it is visually or tactilely identifiable and distinguishable from the top surface of the button cap 111. In an alternative embodiment, the icon 113 is fabricated from a material through which light can transmit to provide a backlit icon 113.

In an embodiment alternative to the power button 110 having two components, the power button 110 is a single piece or unit that also acts as a light guide with an optional icon etched or cut on top of one end. Again, such icon can be backlit or marked for visual or tactile identification.

In one embodiment, the base 112 is customizable for a variety of devices on which the power button structure 100 is implemented. For example, a common button cap 111 is implemented across multiple products or product types to provide a common appearance across a product pallet. In the same example, the base 112 is given maximum flexibility for manufacturing purposes such that it is customizable for each particular product or product types in order to assist in the mechanical actuation of the power button 110. In another embodiment, the base 112 includes a light guide or pipe, which alternatively constitutes the base 112 or forms a part of the base 112, to provide lighting to the power button 110. Because the base 112 is customizable, the light guide is also customizable for connection to a light source of each particular product or product types in order to effectuate the lighting of the power button 110. To that extent, examples of a material 220 for the base 112 include those materials (glass, plastic, optical fiber, et cetera) having any surface types (textured, clear, translucent, et cetera) that are operable for light throughput. Thus, the shape of the base 112 as illustrated in FIGS. 2A-B is merely an example and should not be construed as the only possible configuration or design of the base 112.

In one embodiment, the surrounding area 120 shown in FIGS. 1A-B includes an opening 130 in which the power button 110 is placed or inserted. The opening 130 is substantially the same shape as the button cap 111 of the power button 110 (or in the one-piece power button embodiment, substantially the same shape as the one end of the power button having the optional icon thereon). For example, as shown in FIGS. 2A-B, the button cap 111 exhibits a round shape. Therefore, the opening 130 also exhibits a round shape. In another example, the button cap 111 exhibits a polygonal, curved, or freestyle shape, and the opening 130 also exhibits a corresponding polygonal, curved, or freestyle shape. The term "substantially" is used herein as a qualifier to other descriptive terms to indicate that such descriptive terms cannot be practically exact. For example, the button cap 111 and opening 130 have substantially the same but not exactly identical shape because there may be slight variations in the shapes of the button cap 111 and the opening 130 due to inherent defects in the fabrication or manufacturing of one or both button cap 111 and the opening 130.

Referring now to FIGS. 1D-E, in one embodiment, the opening 130 includes a side wall 132 that bounds the power button 110 when it is placed in the opening 130. The side wall 132 has a curvature at the top of the opening 130 from which the power button 110 protrudes. The curvature has a radius Rc, represented by 134 in FIG. 1E, that is based on the size of the power button 110 as further described later. As referred herein and further illustrated in FIG. 1C, a surround radius Rs, represented by 136, of the opening 130 is the radius that extends from the center of the opening 130 to the edge of the side wall curvature. Thus, the surround radius Rs includes the curvature radius Rc therein. Referring to FIG. 1B, the side wall curvature in the opening 130 provides a crater effect for the opening 130 when the surrounding area 120 is viewed from the top.

The crater effect is such that when the power button 110 is placed in the opening 130, there is a gap between the top of the opening 130 and the power button 110. As further illustrated in FIG. 1D, as the length of the power button 110 extends deeper into the opening 110, the gap gradually diminishes to a predetermined value k due to the curvature of the side wall 132. In one embodiment, the predetermined value k is desired to be as small as possible based on one or more usability constraints, such as manufacturing and application constraints. The crater effect of the opening 130 enables a viewing of light that emanates from the base 112 under the button cap 111, should such base 112 includes a light guide as described earlier. Thus, the light guide of the base 112 and the crater effect of the opening 130 are operable together to produce a light glow around the power button 110 that visually resembles a glow ring, which further produces reflecting light off the side wall curvature of the opening 130 that is visible at any angle from above the power button structure.

Referring to FIG. 1F, with reference to FIGS. 1B and 2B, in one embodiment, the highest point(s) of the power button 110 is flushed, in other words, substantially lie on the same plane along an axis, with the highest point(s) of the surrounding area 120, regardless of the flatness of the surrounding area 120 when the power button is not actuated as shown in FIG. 1F. With a power button 110 having a button cap 111, the highest points 118 on the button cap 111 are where the bevel portion 117 meets the concave portion 119. With the surrounding area 120, the highest points 138 are those points at the perimeter of the surround radius Rs. Thus, the highest points 118 are flushed with the highest points 138.

Figures 3A, 3B, 3C, 3D:
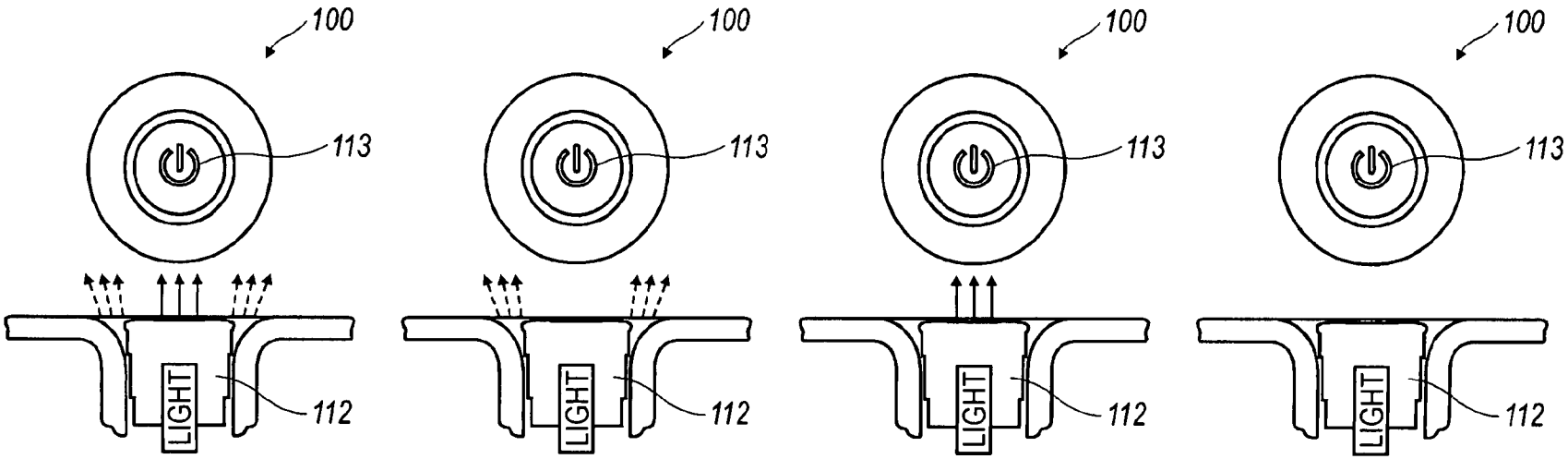
FIGS. 3A-D, illustrate different lighting options for a power button structure in accordance with one embodiment.

Referring to FIGS. 3A-D, the power button structure 100 is operable to provide different lighting options. For example, in one option as shown in FIG. 3A, the power button structure 100 provides full lighting, wherein the base 112 includes a light guide to produce both a glow ring 310 as described above and a back light 320 for the icon 113 when the icon 113 is operable for light throughput to effect a backlit icon. In another option as shown in FIG. 3B, the base 112 includes a light guide, which effects a glow ring 310 but no backlit icon because the icon 113 is not operable for light throughput. In another option as shown in FIG. 3C, the base 112 includes a light guide that is operable such that light is only output through its interface with the button cap 112A, wherein the icon 113 is operable for light throughput to effect a backlit icon. This is possible through, for example, the fabrication of the base 112 with a material or paint that blocks light from leaking out of the base 112, except at its interface with the button cap 112A. In still another option as shown in FIG. 3D, the base 112 does not include a light guide, or includes one that is turned off or not active, to transmit light, which results in neither a backlit icon nor a glow ring.

In one embodiment, the surround radius Rs of the opening 130 is scaled proportional to the radius Rb of the power button 110, shown as 115 in FIG. 1C. The radius Rb is the radius of the button cap 111. In the alternative one-piece power button embodiment, the radius Rb is the radius of the one end of the power button having the optional icon thereon. For example, for a power button 110 having Rb=7 mm, the surround radius Rs is set to 11.9 mm, which is a Rb:Rs ratio of 7:11.9. If the power button 110 is desired to be smaller at, for example, Rb=3.5 mm, for use on, for example, portable or smaller devices, the surround radius Rs is then proportionally set to 5.95 mm to maintain the same ratio Rb:Rs of 7:11.9. Likewise, if the power button 110 is desired to be bigger at, for example, Rb=9.5 mm, for use in, for example, larger floor standing devices, the surround radius Rs is then proportionally set to 16.15 mm to maintain the same ratio of 7:11.9. Thus, once the ratio Rb:Rs is set, it remains constant for a range of power button size, for example, for a power button 110 with $3.5\text{ mm} \leqq Rb \leqq 9.5\text{ mm}$. In one embodiment, the ratio Rb:Rs is set as desired. For example, the ratio Rb:Rs is set based on empirical models of the power button structure 100 built to determine the most effective or desired button lighting or appearance.

With knowledge of the ratio Rb:Rs and a desired value for the radius Rb of the power button 110, the surround radius Rs is found. Furthermore, with additional knowledge of the predetermined gap value k, calculation of the curvature radius Rc is possible from the following equation:

$$Rs=Rb+Rc+k;$$

In one embodiment, while the radius Rb of the power button 110 and the surround radius Rs are proportionally scaled together with a constant ratio Rb:Rs as described above, the icon 113 on the button cap 111 is not proportionally scaled. For example, when Rb is scaled down by 50% from 7 mm to 3.5 mm, as described above, the surround radius Rs is also scaled down by 50% from 11.9 mm to 5.95 mm. However, the icon 113 is scaled down by a percentage different from 50%, for example, 25%. In an alternative embodiment, the icon 113 is also scaled down proportionally together with the radii Rb and Rs, in other words, by 50%.

In another embodiment, while the radius Rb of the power button 110 and the surround radius Rs are proportionally scaled together with a constant ratio Rb:Rs as described above, the ratio Rb:Rs is initially set in light of a desirable ratio Rc:Rs between the curvature radius Rc and the surround radius Rs. The ratio Rc:Rs controls the direction and intensity of light from the base 112, if so equipped with a light guide or source, reflecting off the curvature of the side wall 132. Such control is independent of the type or intensity of the light guide at the base 112. Furthermore, the finish and texture of the surround surface 120, include the side wall 132 of the opening 130, is modifiable to control the appearance of the reflecting light, for example, from sharp to dull.

There are circumstances in which it is desirable to reduce the surround radius Rs. For example, when the power button structure 100 is positioned with a cluster of other buttons or switches on a device, it is not possible to achieve a physical separation of the power button structure 100 from the other buttons or switches. In such cases, the use of the power button structure 100 with its crater opening 130 may interfere with other closely clustered buttons or switches on the device. Therefore, it is at times desirable to reduce the footprint of the power button structure 100 in such overcrowding situation. In one embodiment, the difference between the surround radius Rs to the radius Rb of the power button 110 is reduced by a predetermined amount in order to reduce the footprint of the power button structure 100. This reduction is further described with reference to FIGS. 4A-B as examples.

Figure 4B:
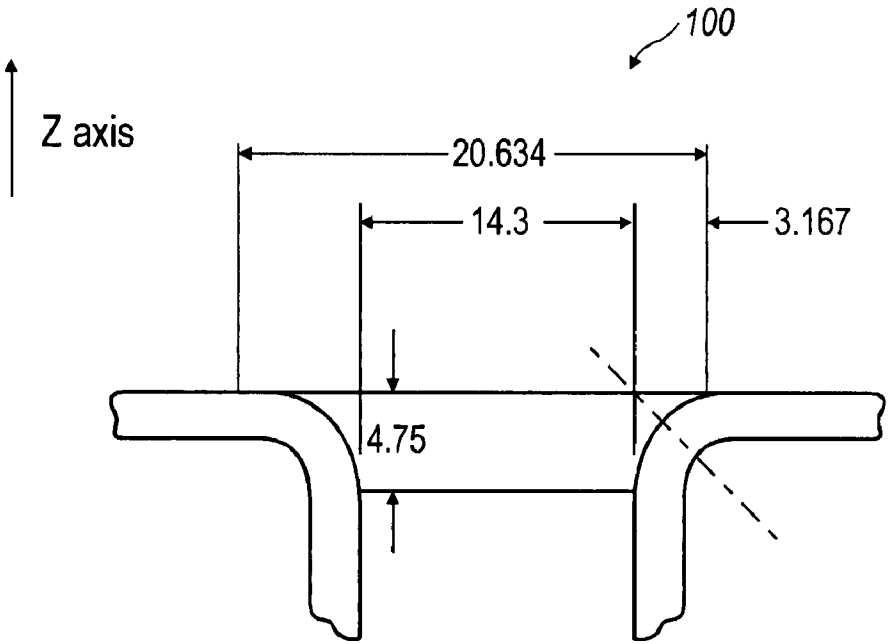
FIGS. 4A-B illustrate a reduction of the footprint of a power button structure in accordance with one embodiment.
Figure 4A:
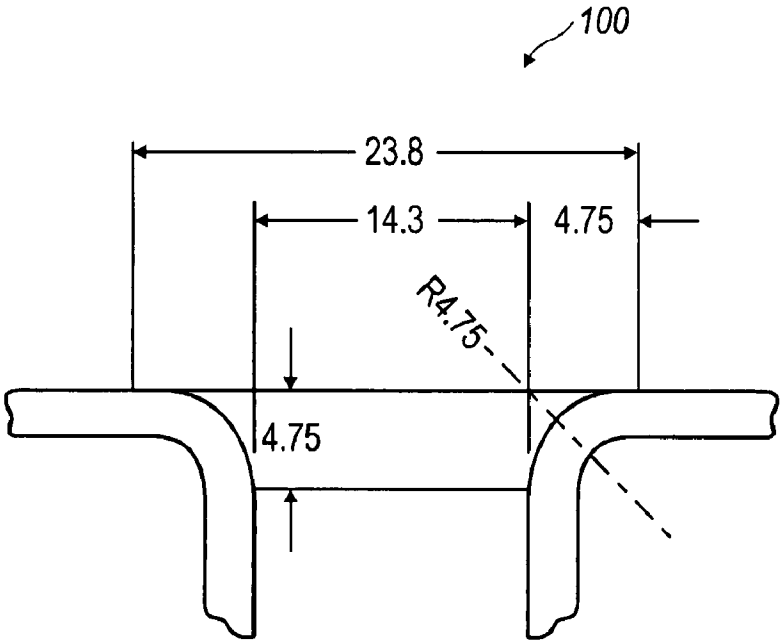

FIG. 4A illustrates a cross section of the power button structure 100 with the power button 110 removed similarly to FIG. 1E. FIG. 4A provides an example of a power button 110 that has a radius Rb=7 mm, or a diameter of 14 mm. With a known ratio of Rb to the surround radius Rs of, for example, 7:11.9 and a predetermined gap value k of 0.3 mm as described earlier, the surround radius Rs is calculated to be 11.9 mm for a total surround diameter of 23.8 mm. Thus, the curvature radius Rc is calculated to be 4.75 mm. To reduce the footprint of the power button structure 100 in overcrowding situations, the 4.75 mm difference between Rs and (Rb+k) is reduced or scaled by a predetermined amount in the x and y axes, which form in a plane along an axis that is perpendicular to the cross section of the power button structure 100 shown in FIG. 4A. In one embodiment, the 4.75-mm distance is reduced by a third to:

$$4.75\text{ mm}\times(2/3)=3.167\text{ mm}.$$

FIG. 4B illustrates a cross section of the power button structure 100 with the power button 110 removed, to show the reduction to 3.167 mm. However, it should be noted that the 4.75 mm curvature radius along the z-axis, which is perpendicular to the x-y plane, is maintained.

Figure 5:
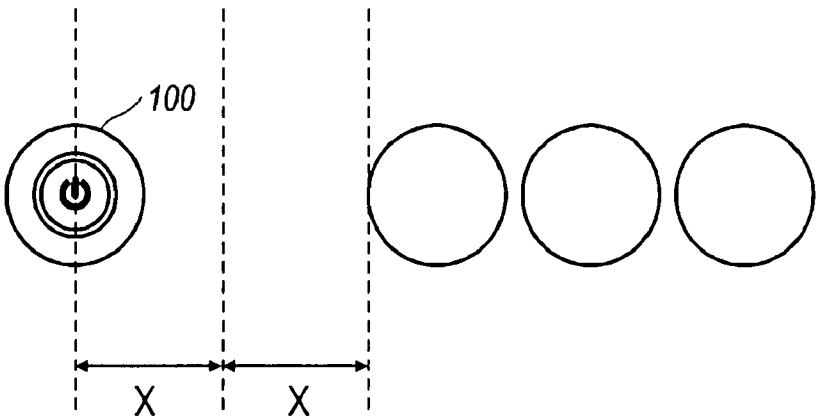
FIG. 5 illustrates a placement of a power button structure on a device in accordance with one embodiment.

Furthermore, referring to FIG. 5, when positioning a cluster of buttons or switches in proximity to the power button structure 100 on the device, the power button 110 is to have at least a distance of 2× between the center of the power button 110 and the edge of the next button, where X is the diameter (or 2Rb) of the power button 110.

Figure 6:
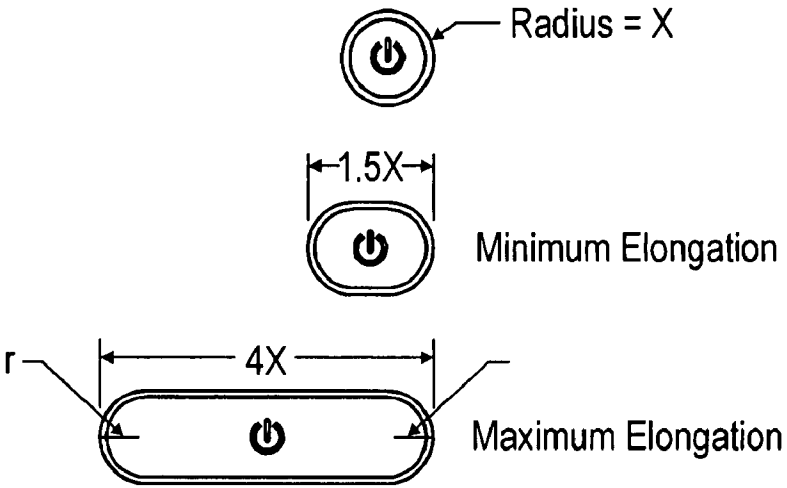
FIG. 6 illustrates a variation of the shape of a power button structure in accordance with one embodiment.

According to another embodiment, in circumstances such as overcrowding conditions on a device, the power button structure 100 is operable to have a shape other than a round shape. For example, FIG. 6 illustrates an elongated or pill-shape power button 500. In this embodiment, the power button 500 exhibits a total length that is at minimum equal to or greater than 150% of the radius r of the opposite curved ends of the button and at a maximum of equal to or less than 400% of such radius. Furthermore, as mentioned earlier, alternative embodiments are contemplated wherein the structure 100 is one other than a power button structure, such as any structure that is capable of being designed to include a surrounding area having an opening with a side wall of a desired curvature and an element that is operable to be inserted into the opening and extends along the side wall.

What has been described and illustrated herein is an embodiment along with some of its variations. The terms, descriptions and figures used herein are set forth by way of illustration only and are not meant as limitations. Those skilled in the art will recognize that many variations are possible within the spirit and scope of the subject matter, which is intended to be defined by the following claims—and their equivalents—in which all terms are meant in their broadest reasonable sense unless otherwise indicated.

What is claimed is:

1. An illuminating structure comprising:

an illuminating element that includes a first component;

a second component interfacing with the first component and providing light for the illuminating element;

a surrounding area, the surrounding area including an opening in which the illuminating element is placed, the opening having a side wall that bounds the illuminating element, the side wall having a curvature at a top of the opening with a predetermined radius Rc that reflects light from the second component of the illuminating element;

a surrounding gap between the first component and the curvature at the top of the opening; and wherein the reflected light is viewable in the surrounding gap.

2. The structure of claim 1, wherein the first component of the illuminating element includes an icon thereon.

3. The structure of claim 2, wherein the icon is visually distinguishable from the rest of the first component.

4. The structure of claim 2, wherein light from the second component of the illuminating element is viewable through the icon.

5. The structure of claim 1, wherein:

the surrounding area includes at least two highest points that substantially lie on a first plane;

the illuminating element includes at least two highest points that substantially lie on a second plane; and the first plane and the second plane are substantially the same plane.

6. The structure of claim 1, wherein the first component of the illuminating element exhibits a round shape.

7. The structure of claim 1, wherein the first component of the illuminating element exhibits a pill shape, the pill shape having a curvature with a radius r at both ends and a length that is no less than 150% of the radius r.

8. The structure of claim 1, wherein the length of the pill shape is no more than 400% of the radius r.

9. The structure of claim 1, wherein the radius Rc has a predetermined value based on a radius of the first component of the illuminating element.

10. The structure of claim 9, wherein the radius of the first component has a range from substantially 3.5 mm to 9.5 mm.

11. The structure of claim 1, wherein the first and second components are the same component.

12. The structure of claim 1, wherein the illuminating element comprises a power indicator.

13. The structure of claim 12, wherein the power indicator comprises a power button.

14. The structure of claim 1, wherein the illuminating element comprises one of a slider switch, a keyboard key, a display screen element, and mechanically-actuated button.

15. The structure of claim 1, wherein the second component of the illuminating element comprises a light guide.

16. A mechanically-actuated button structure comprising:

a mechanically-actuated button having a concave surface, a bevel surrounding the concave surface, and an icon on the concave surface, the mechanically-actuated button exhibits a round-shape with a radius Rb having a range from substantially 3.5 mm to 9.5 mm;

an illuminating element that provides light for the mechanically-actuated button a surrounding area, the surrounding area including an opening in which the mechanically-actuated button is placed, the opening having a side wall that bounds the mechanically-actuated button, the side wall having a curvature at the top of the opening with a radius Rc, the curvature extending by the radius Rc in a first direction in a first axis and by the radius Rc in a second direction in a second axis that is substantially perpendicular to the first plane;

wherein the mechanically-actuated button is placed in the opening such that it extends in the opening along the first axis, and at least two highest points on the mechanically-actuated button substantially lie on the second plane such that the mechanically-actuated button is flushed with the surrounding area;

wherein the radius Rc has a predetermined value based on the radius Rb and wherein reflected light is viewable through a surrounding gap between the mechanically-actuated button and the curvature at the top of the opening.

17. An illuminating structure comprising:

first means for light illumination, the first means having a cross section with a curved portion defined by a radius Rb;

second means for providing the first means with a pictorial representation;

third means for surrounding the first means with a side wall having a curvature at a top of an opening of the side wall defined by a radius Re that is based on the radius Rb;

a surrounding gap between the first means and the curvature at the top of the opening;

and wherein the side wall curvature provides a reflection of the light illumination in the surrounding gap.

* * * * *

UNITED STATES PATENT AND TRADEMARK OFFICE

CERTIFICATE OF CORRECTION

PATENT NO. : 7,692,111 B1
APPLICATION NO. : 11/192959
DATED : April 6, 2010
INVENTOR(S) : Dustin Rosing et al.

It is certified that error appears in the above-identified patent and that said Letters Patent is hereby corrected as shown below:

In column 7, line 26, in Claim 16, delete "button" and insert -- button; --, therefor.

In column 8, line 13, in Claim 16, delete "Rb" and insert -- Rb; --, therefor.

In column 8, line 25, in Claim 17, delete "Re" and insert -- Rc --, therefor.

Signed and Sealed this

Thirteenth Day of July, 2010

David J. Kappos

David J. Kappos
*Director of the United States Patent and Trademark Office*